US011801956B2

(12) United States Patent
Degliesposti et al.

(10) Patent No.: US 11,801,956 B2
(45) Date of Patent: Oct. 31, 2023

(54) FILLING UNIT TO FILL A CONTAINER, IN PARTICULAR A CARTRIDGE, WITH A LIQUID PRODUCT OF THE PHARMACEUTICAL INDUSTRY

(71) Applicant: G.D SOCIETA' PER AZIONI, Bologna (IT)

(72) Inventors: Paolo Degliesposti, Bologna (IT); Luca Testoni, Bologna (IT); Mirco Legnani, Bologna (IT); Luca Federici, Bologna (IT)

(73) Assignee: G.D SOCIETA' PER AZIONI, Bologna (IT)

( * ) Notice: Subject to any disclaimer, the term of this patent is extended or adjusted under 35 U.S.C. 154(b) by 0 days.

(21) Appl. No.: 17/595,138

(22) PCT Filed: May 22, 2020

(86) PCT No.: PCT/IB2020/054878

§ 371 (c)(1),
(2) Date: Nov. 9, 2021

(87) PCT Pub. No.: WO2020/234842

PCT Pub. Date: Nov. 26, 2020

(65) Prior Publication Data

US 2022/0212822 A1 Jul. 7, 2022

(30) Foreign Application Priority Data

May 23, 2019 (IT) ..... 102019000007150

(51) Int. Cl.
*B65B 31/04* (2006.01)
*B65B 3/00* (2006.01)
(Continued)

(52) U.S. Cl.
CPC ..... *B65B 31/041* (2013.01); *B65B 3/003* (2013.01); *B65B 3/12* (2013.01); *B65B 3/22* (2013.01); *B65B 7/2842* (2013.01)

(58) Field of Classification Search
CPC .... B65B 1/26; B65B 3/00; B65B 3/22; B65B 31/04
(Continued)

(56) References Cited

U.S. PATENT DOCUMENTS 2,362,791 A 11/1944 Ayars
2,753,098 A 7/1956 Ward
(Continued)

FOREIGN PATENT DOCUMENTS

CN 201543276 U 8/2010
CN 102838062 A 12/2012
(Continued)

OTHER PUBLICATIONS

International Search Report and Written Opinion for corresponding International Application No. PCT/IB2020/054878, dated Oct. 6, 2020.
(Continued)

*Primary Examiner* — Timothy L Maust
(74) *Attorney, Agent, or Firm* — MARSHALL, GERSTEIN & BORUN LLP

(57) ABSTRACT

A filling unit to fill a container, in particular a cartridge, with a liquid product of the pharmaceutical industry having: a dosing head, which is arranged in a filling station and is designed to feed a quantity of product into the container through an open upper end of the container; a capping device, which is arranged in a capping station and is designed to insert a closing element into the container and through the open upper end of the container; and a sucking device which is arranged in a degasification station located between the filling station and the capping station, is designed to engage the open upper end of the container in a sealing manner, and is designed to generate a depression inside the container in an upper volume, which is not occupied by the product.

12 Claims, 3 Drawing Sheets

(51) Int. Cl.

| | |
|---|---|
| ***B65B 3/12*** | (2006.01) |
| ***B65B 3/22*** | (2006.01) |
| ***B65B 7/28*** | (2006.01) |

(58) Field of Classification Search
USPC ..... 53/432
See application file for complete search history.

(56) References Cited

U.S. PATENT DOCUMENTS

| | | | | |
|---|---|---|---|---|
| 5,519,984 | A | 5/1996 | Beussink et al. | |
| 8,726,615 | B2 * | 5/2014 | Desrues | B05B 11/0097 53/410 |
| 2007/0175538 | A1 | 8/2007 | Rothbauer et al. | |
| 2015/0190578 | A1 * | 7/2015 | Okihara | B65B 7/2821 53/111 R |
| 2017/0081056 | A1 | 3/2017 | Zambaux et al. | |

FOREIGN PATENT DOCUMENTS

| | | | | |
|---|---|---|---|---|
| DE | 19928845 | A1 * | 12/2000 | B65B 3/003 |
| GB | 1544671 | A | 4/1979 | |
| KR | 20120131781 | A | 12/2012 | |
| KR | 20160063692 | A | 6/2016 | |
| WO | WO-9819715 | A1 * | 5/1998 | A61L 2/07 |
| WO | WO-2011114061 | A1 | 9/2011 | |

OTHER PUBLICATIONS

Chinese Office Action for corresponding Chinese Application No. 202080034251.5, dated Feb. 11, 2023.

* cited by examiner

FILLING UNIT TO FILL A CONTAINER, IN PARTICULAR A CARTRIDGE, WITH A LIQUID PRODUCT OF THE PHARMACEUTICAL INDUSTRY

CROSS-REFERENCE TO RELATED APPLICATIONS

This patent application is a U.S. national phase of International Patent Application No. PCT/IB2020/054878 filed May 22, 2020, which claims the benefit of priority from Italian patent application no. 102019000007150 filed on May 23, 2019, the respective disclosures entire disclosure of which is are each incorporated herein by reference in their entireties.

TECHNICAL FIELD

The present invention relates to a filling unit to fill a container with a liquid product of the pharmaceutical industry.

The present invention finds advantageous application for the filling of a container with a liquid product, for example a medicine, in particular a cartridge (Carpule®, hereinafter simply cartridge), i.e. a tubular container provided with a sliding piston to allow the injection of the liquid product directly from the inside of said container. The same advantageous application is provided with the use of other similar containers, for example "ready-to-use" syringes.

PRIOR ART

Normally, an empty syringe is used to perform an injection which initially sucks the liquid medicinal product from a vial; however, this procedure exposes the liquid medicinal product to the risk of contamination during the transfer from the vial to the syringe. To solve this problem, the so-called Carpule® was introduced in 1925, i.e. a container provided with a sliding plunger to allow the injection of the liquid medicinal product directly from the inside of the container. In other words, the system is formed by a ready-to-use cylindrical glass container (the so-called Carpule®) and a special metal syringe. The cylindrical-shaped glass container, a glass tube closed on both sides with rubber stoppers, needs only to be inserted in the cartridge slot provided in the syringe: a double-ended injection needle pierces the front rubber stopper and the syringe is ready for use. During the injection, the rear rubber stopper of the cartridge acts as a piston, which is pushed forward by the plunger of the syringe. In this way it is possible to prepare the injection with a simple procedure without the risk of contamination of the sterile solution for injection. Alternatively, "ready-to-use" syringes can be used.

A filling unit to fill a container (in particular cartridge or syringe) comprises a conveying system which feeds a plurality of containers organized in an array through a filling station in which initially each container (already provided with a respective sealed cap and arranged "upside down") receives from the bottom (temporarily oriented upwards) a quantity of liquid product and subsequently receives in the bottom a piston which tightly closes (i.e. seals) the container (i.e. acts as a rear cap).

An undesirable problem that occurs with the known filling units is that, following the closure of the containers, the liquid therein contains numerous air bubbles, which can complicate the subsequent use of the liquid.

In addition, the operating speed of the filling unit described above is not optimal.

DESCRIPTION OF THE INVENTION

The object of the present invention is to provide a filling unit to fill a container, in particular a cartridge, with a liquid product of the pharmaceutical industry, which filling unit allows to eliminate the air bubbles present in the liquid before closing the container.

A further object of the invention is to provide a filling unit having an optimal operating speed with respect to the known art.

According to the present invention, a filling unit to fill a container, in particular a cartridge, is provided with a liquid product of the pharmaceutical industry, according to what is claimed in the attached claims.

The claims describe embodiments of the present invention forming an integral part of the present description.

BRIEF DESCRIPTION OF THE DRAWINGS

The present invention will now be described with reference to the attached drawings, which illustrate a non-limiting example of embodiment, wherein.

PREFERRED EMBODIMENTS OF THE INVENTION

Figure 1:
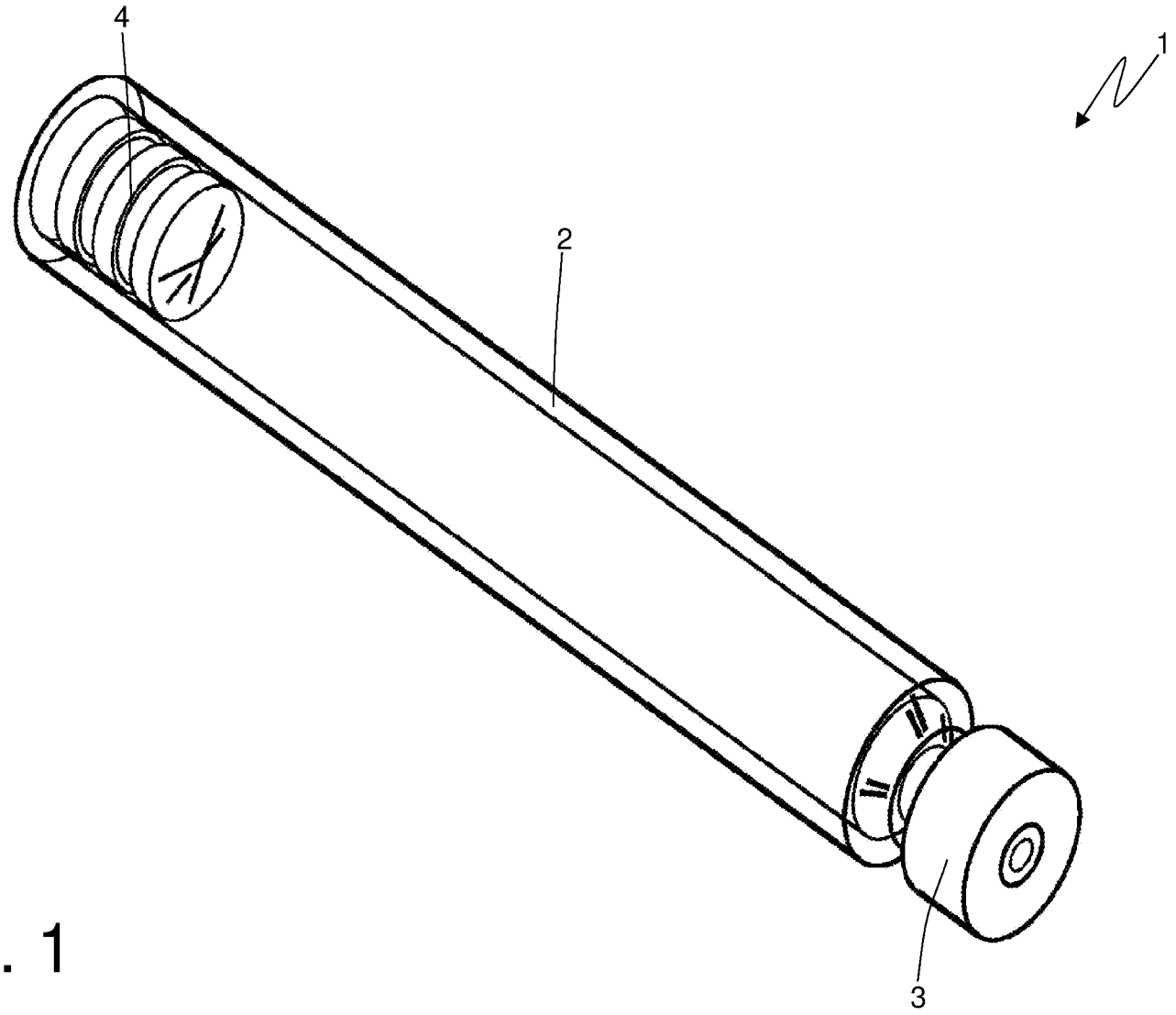
FIG. 1 is a perspective view of a container, in particular a cartridge, for liquid products.
Figure 2:
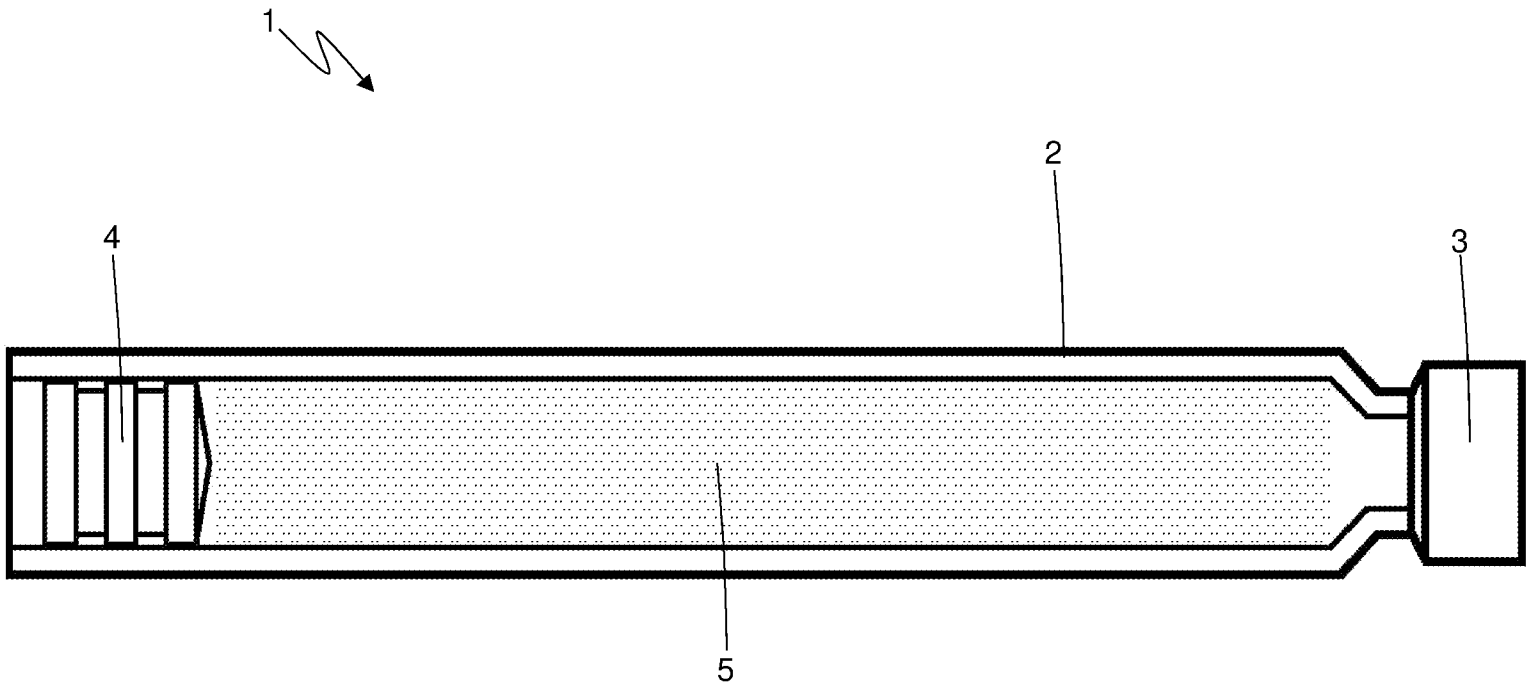
FIG. 2 is a side and partially sectioned view of the cartridge of FIG. 1.

In FIGS. 1 and 2, number 1 denotes as a whole a disposable container, specifically a cartridge (Carpule®) of the pharmaceutical industry. In the following, specific reference will be made to this type of container, without the invention losing its generality, as it can be advantageously applied to other containers for liquids of the pharmaceutical industry, for example syringes.

The cartridge 1 comprises a tubular body 2 closed at the front by a sealed cap 3 which can be centrally pierced (i.e. can be crossed through with relative ease by a needle) and closed at the rear by a piston 4 which acts as a rear cap and in use is designed to slide along the tubular body 2 to push a liquid product 5 outwards.

Figure 3:
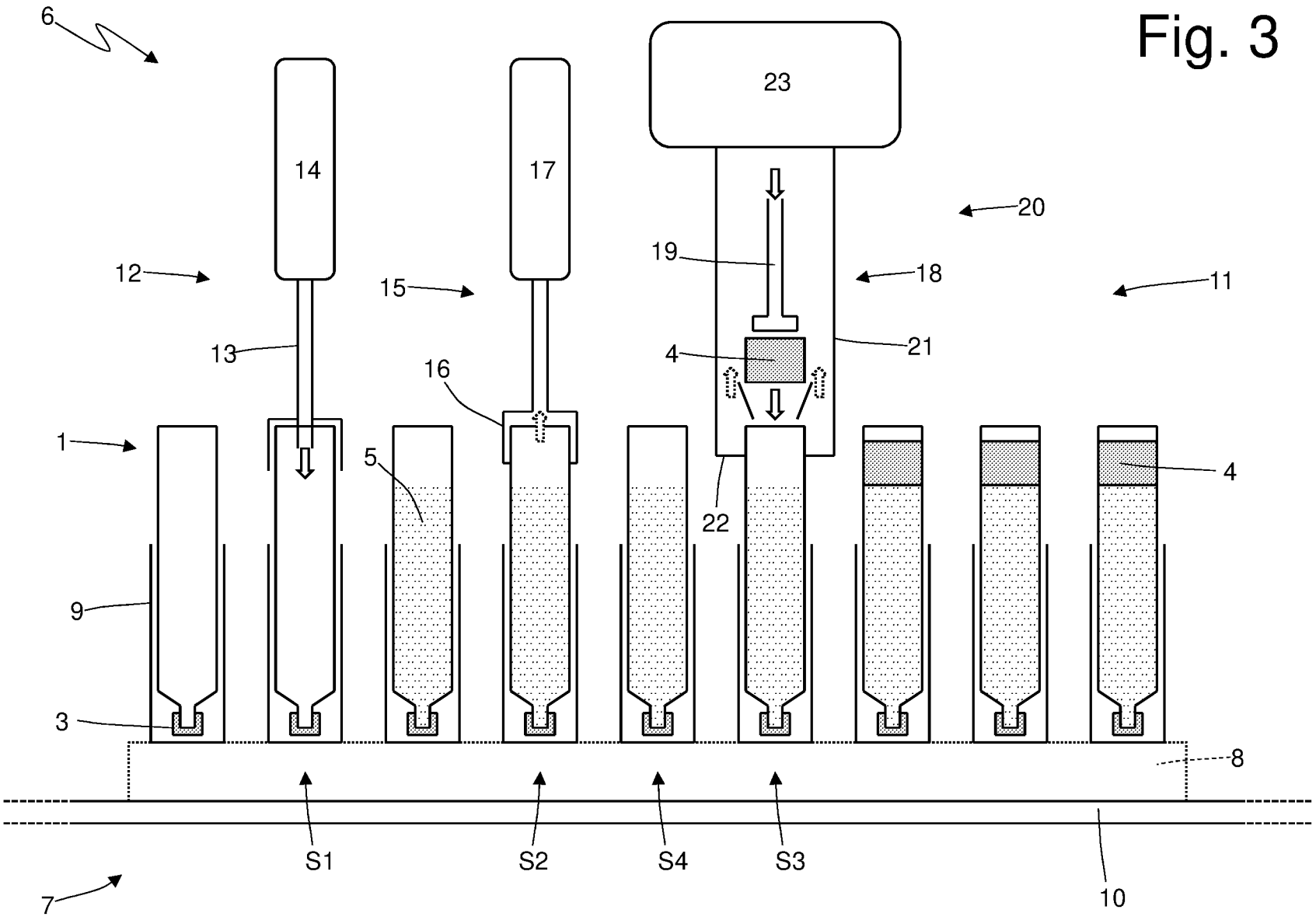
FIG. 3 is a schematic view of a filling unit of the cartridge of FIG. 1.

In FIG. 3, number 6 denotes a portion of a filling machine for filling a cartridge 1 of the type illustrated in FIG. 1.

The filling machine 6 comprises a feeding conveyor 7 which is designed to feed a group of cartridges 1 through a filling station S1 in which a quantity of liquid product 5 is fed inside each cartridge 1, through a subsequent degasification station S2, and finally through a capping station S3 in which a corresponding piston 4 (which acts as a rear cap) is inserted inside each cartridge 1.

According to a possible embodiment, the feeding conveyor 7 comprises (at least) a transport base 8 having a plurality of pockets 9, each of which is designed to house a corresponding cartridge 1 arranged "upside down" (i.e. with the bottom, still open facing upwards and with the cap 3 facing downwards); for example, each transport base 8 can have 15-30 pockets 9 oriented to form an array (i.e. on multiple rows and on multiple columns). Furthermore, the feeding conveyor 7 comprises a feeding device 10 which is designed to feed the transport base 8 through the stations S1, S2 and S3 with a step law of motion (i.e. a law of motion which cyclically alternates stopping and movement steps).

A filling unit 11 is arranged at the stations S1, S2 and S3 which carries out, among other things, the filling (in the filling station S1) and the capping (in the capping station S3) operations.

The filling unit 11 comprises a dosing head 12 which is arranged in the filling station S1 and is designed to feed a quantity of liquid product 5 inside each cartridge 1 which is located in the filling station S1. In particular, the dosing head 12 comprises a row of cannulas 13 (only one of which is illustrated in FIG. 3) which are inserted into respective cartridges 1 through the open upper ends of the cartridges 1 and deliver respective quantities of liquid product 5. Each cannula 13 is vertically movable and receives the liquid product 5 from a calibrated dosing device 14 arranged above the cannula 13.

The filling unit 11 comprises a sucking device 15 which is arranged in the degasification station S2 (which is located between the filling station S1 and the capping station S3), is designed to engage the open upper end of each cartridge in a sealing manner, which is located in the degasification station S2, and is designed to generate a depression inside each cartridge 1 in an upper volume not occupied by the liquid product 5. In particular, the sucking device 15 is designed to generate a depression inside each cartridge 1 in an upper volume, which is not occupied by the liquid product 5, by sucking only and exclusively air, i.e. without sucking any part of the liquid product 5 or any foam which is generated during the feeding of the liquid product 5; this result is obtained by causing the sucking device 15 to generate a depression sufficient to suck part of the air but completely insufficient to suck any part of the liquid product 5 or any foam that is generated during the feeding of the liquid product 5.

According to a possible embodiment, the sucking device 15 is designed to generate a depression inside each cartridge 1 ranging from 1,000 to 10,000 Pascals and is designed to maintain the depression for a time ranging from 0.4 to 3 seconds.

According to a possible embodiment illustrated in FIG. 3, the sucking device 15 comprises a plurality of elastic caps 16 (only one of which is illustrated in FIG. 3), each of which is designed to engage the open upper end of a corresponding cartridge 1 in a sealing manner. Each elastic cap 16 is connected by means of a flexible duct to a suction source 17 (typically a vacuum pump) which can be common for all elastic caps 16.

The filling unit 11 comprises a capping device 18 which is arranged in the capping station S3 and is designed to insert a piston 4 (i.e. a closing element) inside each cartridge 1 which is located in the capping station S3 and through the open upper end of the cartridge 1. Generally, the capping device 18 comprises a plurality of pushers 19 (only one of which is illustrated in FIG. 3) which are designed to force the pistons 4 (i.e. the closing elements) inside the corresponding cartridges 1 located in the capping station S3 and through the open upper ends of the cartridges 1. Generally, a compression element is coupled to each pusher 19 which has a funnel shape and elastically and radially compresses a corresponding piston 4 to make the piston 4 smaller and thus facilitate the entry of the piston 4 through the open upper end of a cartridge 1.

The filling unit 11 comprises a sucking device 20, which is arranged in the capping station S3, is designed to engage the open upper end of each cartridge 1 in a sealing manner, located in the capping station S3, and is designed to generate a depression inside each cartridge 1, in an upper volume not occupied by the liquid product 5, and during the insertion of the piston 4 (i.e. the closing element). In other words, simultaneously with the insertion of the piston 4 in a cartridge 1, the sucking device 20 generates a depression in an upper volume, not occupied by the liquid product 5. Similar to the sucking device 15, also the sucking device 20 is designed to generate a depression inside each cartridge 1 in an upper volume not occupied by the liquid product 5, by sucking only and exclusively air, i.e. without sucking any part of the liquid product 5 or a possible foam that is generated during the feeding of the liquid product 5; this result is obtained by causing the sucking device 20 to generate a depression sufficient to suck part of the air but completely insufficient to suck any part of the liquid product 5 or any foam that is generated during the feeding of the liquid product 5.

The sucking device 20 comprises, for each cartridge 1 located in the capping station S3, a chamber 21 inside which the depression is generated and along which the piston 4, pushed by the pushing device 20, is caused to pass.

According to a possible embodiment illustrated in FIG. 3, the sucking device 20 comprises a plurality of elastic caps 22 (only one of which is illustrated in FIG. 3), each of which is designed to engage the open upper end of a corresponding cartridge 1 in a sealing manner, and forming the terminal part of a chamber 21. Each chamber 21 (and therefore each elastic cap 22) is connected by means of a flexible duct to a suction source 23 (typically a vacuum pump) which can be common for all chambers 21 (and therefore for all the elastic caps 22).

According to a possible embodiment, the sucking device 20 is designed to generate a depression inside each cartridge 1 ranging from 1,000 to 10,000 Pascals and is designed to maintain the depression for a time ranging from 0.2 to 2 seconds.

According to a preferred embodiment illustrated in FIG. 3, a resting station S4 is arranged between the degasification station S2 and the capping station S3, in which the end of each cartridge 1 is free and in communication with the external environment.

According to an alternative not illustrated, the filling unit 11 comprises a further sucking device, located at the filling station S1, designed to generate a depression inside each cartridge 1 during filling, even if this depression is (in absolute value), lower than that performed in the degasification station S2 and in the capping station S3 (i.e. weaker).

The embodiments described herein can be combined with each other without departing from the scope of the present invention.

The filling unit 11 described above has numerous advantages.

Firstly, the filling unit 11 described above allows to obtain closed, liquid filled containers, in which no air bubbles inside the liquid are present.

Secondly, the filling unit 11 described above allows to speed up the delivery of the liquid product 5 into the filling station 1 (therefore, allowing an increased operating speed) without penalizing the final quality of the cartridges 1 since any excess air trapped in the liquid inside the cartridges 1 is efficiently and effectively evacuated by the action of the two sucking devices 15 and 20.

In addition, the filling unit 11 described above is simple and inexpensive to implement, since compared to a similar known filling unit requires the addition of a few elements (the two sucking devices 15 and 20) formed by commercial components.

The invention claimed is:

1. A filling unit (11) to fill a container (1) with a liquid product (5) of the pharmaceutical industry; the filling unit (11) comprising:

a dosing head (12), which is arranged in a filling station (S1) and is designed to feed a quantity of product (5) into the container (1) through an open upper end of the container (1);

a capping device (18), which is arranged in a capping station (S3) and is designed to insert a closing element into the container (1) and through the open upper end of the container (1); and a first sucking device (15), which is arranged in a degasification station (S2) located between the filling station (S1) and the capping station (S3), is designed to engage the open upper end of the container (1) in a sealing manner, and is designed to generate a depression inside the container (1) in an upper volume, which is not occupied by the product (5), wherein:

the first sucking device (15) is designed to generate the depression inside the container (1) in the upper volume, which is not occupied by the product (5), by sucking only and exclusively air and without sucking any part of the product or any foam that is generated during feeding of the product.

2. The filling unit (11) according to claim 1, wherein the first sucking device (15) is designed to generate a depression sufficient to suck part of the air but completely insufficient to suck any part of the product (5) or any foam that is generated during the feeding of the product (5).

3. The filling unit (11) according to claim 1, wherein the first sucking device (15) is designed to generate a depression inside the container (1) ranging from 1,000 to 10,000 Pascal and is designed to maintain the depression for an amount of time ranging from 0.4 to 3 seconds.

4. The filling unit (11) according to claim 1, wherein the first sucking device (15) comprises a first elastic cap (16), which is designed to engage the open upper end of the container (1).

5. The filling unit (11) according to claim 1 and comprising a second sucking device (20), which is arranged in the capping station (S3), is designed to engage the open upper end of the container (1) in a sealing manner, and is designed to generate a depression inside the container (1) in an upper volume, which is not occupied by the product (5), during the insertion of the closing element.

6. The filling unit (11) according to claim 5, wherein the second sucking device (20) is designed to generate a depression inside the container (1) in the upper volume, which is not occupied by the product (5), by sucking only and exclusively air.

7. The filling unit (11) according to claim 6, wherein the second sucking device (20) is designed to generate a depression inside the container (1) in the upper volume, which is not occupied by the product (5), by sucking only and exclusively air and therefore without sucking any part of the product (5) or any foam that is generated during the feeding of the product (5).

8. The filling unit (11) according to claim 5, wherein the second sucking device (20) is designed to generate a depression sufficient to suck part of the air but completely insufficient to suck any part of the product (5) or any foam that is generated during the feeding of the product (5).

9. The filling unit (11) according to claim 5, wherein the second sucking device (20) comprises a chamber (21), inside which the depression is generated and along which the closing element is caused to pass.

10. The filling unit (11) according to claim 5, wherein the second sucking device (20) is designed to generate a depression inside the container (1) ranging from 1,000 to 10,000 Pascal and is designed to maintain the depression for an amount of time ranging from 0.2 to 2 seconds.

11. The filling unit (11) according to claim 5, wherein the second sucking device (20) comprises a second elastic cap (22) which is designed to engage the open upper end of the container (1).

12. The filling unit (11) according to claim 5, wherein between the degasification station (S2) and the capping station (S3) there is a rest station (S4), in which the end of the container (1) is free and in communication with the external environment.

* * * * *